United States Patent [19]

Bilsbury

[11] Patent Number: 4,649,829

[45] Date of Patent: Mar. 17, 1987

[54] PLASTIC ARMOR PIERCING PROJECTILE

[75] Inventor: Stephen J. Bilsbury, Godfrey, Ill.

[73] Assignee: Olin Corporation, Stamford, Conn.

[21] Appl. No.: 667,718

[22] Filed: Nov. 2, 1984

[51] Int. Cl.[4] ..... F42B 11/00

[52] U.S. Cl. ..... 102/515; 102/516; 102/517

[58] Field of Search ..... 102/516, 517, 515

[56] References Cited

U.S. PATENT DOCUMENTS 3,720,170 3/1973 Godfrey ..... 102/516
3,861,311 1/1975 Bilsbury ..... 102/515
4,015,535 4/1977 Bond, Jr. ..... 102/516
4,323,012 4/1982 Driyer, Jr. ..... 102/515

FOREIGN PATENT DOCUMENTS 2540239 8/1984 France ..... 102/516

*Primary Examiner*—Peter A. Nelson
*Attorney, Agent, or Firm*—Bruce E. Burdick

[57] ABSTRACT

A plastic covered armour piercing projectile with tubular monocoque penetrator surrounded by lightweight metal washers mounted on a metal butt plug all surrounded by an aerodynamic plastic skin.

9 Claims, 1 Drawing Figure

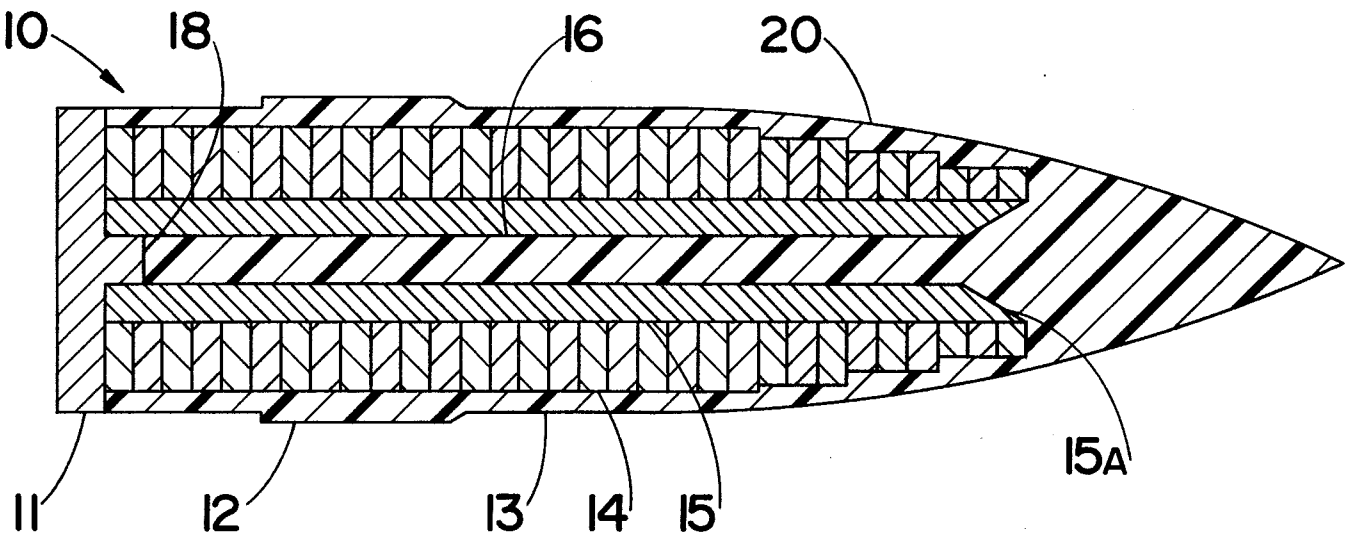
10
18
16
20
15A
15
14
13
12
11

PLASTIC ARMOR PIERCING PROJECTILE

This invention relates to armor piercing projectiles.

With the increasing tendency of the world's armed forces toward armored personnel carriers and other mobile armored equipment to achieve rapid deployment, comes an increasing need for ammunition which can penetrate such armor and yet do other damage such as leave shrapnel or explode. Fragmenting armor piercing rounds traditionally employ explosives to cause widespread fragmentation by explosively fragmenting a projectile body. However, this requires use of parasitic weight in the form of explosives to cause the fragmentation.

The present invention provides an armor penetrating round with added penetrating ability and shrapnel producing effects without need for explosives. The present invention does this by providing a plastic outer skin molded over a column of aluminum washers within which is aligned a tubular core of heavy metal with a separate steel butt plate at the rear of the projectile bonded to the projectile skin.

The invention will be better understood by reference to the attached drawing in which the sole FIGURE is a longitudinal cross-sectional view of the preferred projectile of the invention.

Referring to FIG. 1, a projectile 10 is shown in a longitudinal cross-sectional view taken along the projectile axis. Projectile 10 comprises a disc like butt plug 11, a plastic skin 13 with an integral plastic rotating band 12, a coaxial stack of annular washers 14, a heavy metal tubular penetrator 15 and a plastic core 16.

Butt plug 11 is preferably made of steel so that it is hard enough to also serve as an armor penetrating body upon impact. Plug 11 is a solid metal disc with a central boss 18 projecting forwardly. Boss 18 is a cylinder with an outer diameter slightly less than the inside diameter of tubular penetrator 15 serves to help hold penetrator 15 in axial alignment during molding and projectile launch. Butt plug 11 is of a diameter conforming to the lands of the rifled barrel through which it is expected to be fired so that plug 11 serves as a "bore rider" to help prevent balloting. Rotating band 12 is conventional and serves to engage the lands and grooves of the barrel through which projectile 10 is expected to be launched. Skin 13 is an aerodynamic plastic covering which serves to hold the projectile components together through cartridge loading, chambering, launch and flight to the target to help the projectile arrive at the target with all its components still in proper alignment. The outer surface of skin 13 is of an aerodynamic shape to give greater exterior ballistics. Lightweight washer stack 14 is made of a multiplicity of coaxially stacked aluminum or other light metal washers (i.e. annular discs). Aluminum is preferred because it is not only light to allow more weight to be put in the penetrator 15 for a given weight projectile, but also is flammable under expected impact conditions to disperse burning shrapnel upon impact.

Penetrator 15 is of a heavy metal and takes advantage of the projectile 10 having a monocoque design (i.e. a design wherein the outer layers of the projectile carry all or a major part of the stresses of loading, launch, and in the present case initial target impact). The tubular design of penetrator 15 increases the sectional impact density of the penetrator, and the front 15*a* of penetrator 15 is forwardly flared to further increase the sectional impact density. By sectional impact density is meant the weight of the body in question divided by the area which impacts the target. In the present case, the impact area is, at most, a thin annulus defined by the front tip of penetrator 15. If the angle of impact (called "angle of obliquity" in the trade) is other than 0° (straight orthogonally against the target) the impact area would be less and the effective sectional density higher. To put it another way, this projectile tends to dig into the target rather than bounce off when shot at an angle to the target or when shot straight but hitting a sloped surface.

The projectile operates as follows. At all angles except normal to the surface of the target, the aluminum washers act individually by deflecting at the point of impingement on the target surface deflect and embed themselves into the surface of the target. As each washer digs into the surface, it becomes deformed and exposes the edge of the next washer. Thus, a long series of sharp edges is exposed to the target. As this action occurs, it allows the heavy metal penetrator to move forward into the target surface and penetrate at oblique angles. The exterior core of washers also serves to throw the penetrator towards a more normal angle with the target, thus affording a better chance of penetration. Since the penetrator is of heavy metal and of monocoque design, it has the advantage of both a high sectional density and high stiffness at the point of impingement. Because of the monocoque design, the penetrator resists bending during process of penetration at high angles of obliquity. Under normal circumstances a solid penetrator, upon impinging on a target at high angles of obliquity, bends to conform to the surface of the target. This allows the solid metal penetrator to ricochet and thus not penetrate the target.

What is claimed is:

1. An armor piercing projectile which comprises:

a tubular heavy metal monocoque penetrator;

a coaxial stack of annular lightweight metal discs stacked coaxially about the penetrator;

a metal disc-like butt plug disposed coaxial with and immediately behind the penetrator;

a plastic aerodynamic skin molded about said penetrator, discs and plug to hold them in position during loading, launch and flight to the target while providing an aerodynamically efficient external shape to the overall projectile.

2. The projectile of claim 1 wherein said discs are of aluminum.

3. The projectile of claim 2 wherein said penetrator is made of tungsten carbide.

4. The projectile of claim 2 wherein said penetrator is made of tungsten alloy.

5. The projectile of claim 2 wherein the penetrator is made of depleted uranium.

6. The projectile claim 2 wherein the plug is made of steel.

7. The projectile of claim 2 wherein the plastic skin includes an integral rotating band.

8. The projectile of claim 1 wherein the butt plug is full caliber so that it can ride the lands of barrel bores through which it is intended to be fired.

9. The projectile of claim 1 wherein said discs are of a pyrophoric light metal material.

* * * * *